US006453138B1

(12) United States Patent
Inoue et al.

(10) Patent No.: US 6,453,138 B1
(45) Date of Patent: Sep. 17, 2002

(54) ELECTROPHOTOGRAPHIC IMAGE FORMING METHOD, ELECTROPHOTOGRAPHIC IMAGE FORMING APPARATUS AND ELECTROPHOTOGRAPHIC IMAGE FORMING PROCESS UNIT

(75) Inventors: Toyofumi Inoue, Minamiashigara (JP); Masahiro Uchida, Minamiashigara (JP); Etsuo Tominaga, Minamiashigara (JP); Michio Take, Minamiashigara (JP); Tomohiro Takeda, Minamiashigara (JP); Shinpei Takagi, Minamiashigara (JP); Satoshi Yoshida, Minamiashigara (JP); Takahisa Fujii, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/941,787

(22) Filed: Aug. 30, 2001

(30) Foreign Application Priority Data

Sep. 6, 2000 (JP) ..... 2000-270507

(51) Int. Cl.[7] ..... G03G 15/09
(52) U.S. Cl. ..... 399/159; 399/267
(58) Field of Search ..... 399/111, 167, 399/159, 267; 430/122

(56) References Cited

U.S. PATENT DOCUMENTS 6,366,751 B1 * 4/2002 Shakuto et al. ..... 399/159

FOREIGN PATENT DOCUMENTS

JP 10-198244 A 7/1998

* cited by examiner

*Primary Examiner*—William J. Royer
(74) *Attorney, Agent, or Firm*—Oliff & Berridge, PLC

(57) ABSTRACT

An electrophotographic image forming method includes a charging step, an exposure step, a developing step and a transfer step in the rotation of an electrostatic latent image bearing member, in which a process speed of the electrostatic latent image bearing member is 200 to 500 mm/sec, an outer diameter of the electrostatic latent image bearing member is 15 to 35 mm, an outer diameter of a developer bearing member is 10 to 25 mm, and a magnetic single component developer of which the residual magnetization in a measured magnetic field of 796 kA/m is 0.5 to 5.0 $Am^2/kg$ is used as the developer. The electrophotographic image forming method can provide a good image quality without causing scattering of toner in downsizing, weight reduction of an electrophotographic apparatus and speed-up of an electrophotographic process.

20 Claims, 2 Drawing Sheets

ELECTROPHOTOGRAPHIC IMAGE FORMING METHOD, ELECTROPHOTOGRAPHIC IMAGE FORMING APPARATUS AND ELECTROPHOTOGRAPHIC IMAGE FORMING PROCESS UNIT

FIELD OF THE INVENTION

The present invention relates to an electrophotographic image forming method, an electrophotographic image forming apparatus and an electrophotographic image forming process unit. More specifically, it relates to an electrophotographic image forming method using a magnetic single component developer.

DESCRIPTION OF THE RELATED ART

In recent years, dry development in an electrostatic copying method has found wide acceptance in the field of electrophotographic apparatus for personal users, such as printers and facsimiles, and further downsizing and weight reduction of apparatus have been in demand. Besides, in these electrophotographic apparatus, the speed-up of the electrophotographic process has been required, and various improvements or new developments of the image forming method have been studied for providing a higher-image quality under severe conditions.

The dry development in various electrostatic copying methods which have been currently put to practical use includes two-component developer using a toner and a carrier such as an iron powder and single component development in the absence of a carrier. The use of two-component development has been most widespread. This development involves, however, the following defects. That is, a developer is deteriorated by adhering it to the surface of the carrier, or the developer alone is consumed. Consequently, the mixing ratio of the toner and the carrier has to be kept constant lest the amount of the developer is decreased. A developing unit has therefore a large size.

Meanwhile, single component development is free from these defects because of the absence of the carrier, and is advantageous in downsizing the apparatus. For this reason, single component development is becoming the preferred method of development in electrophotographic apparatus for small offices or personal users. Single component development is roughly classified into nonmagnetic single component development using a nonmagnetic toner and magnetic single component development using a magnetic toner. Since a magnetic material is not used in the toner in the nonmagnetic single component development, it is suited for coloration. However, the developer is carried on a developer bearing member mainly by an electrostatic force alone by mutual triboelectric charging of the developer and the developer bearing member. Accordingly, when a charge amount of the developer is small, problems such as fogging of a non-image area and contamination of an apparatus tend to occur. Thus, this development is not preferred in a monochromic electrostatic copying method. Meanwhile, in magnetic single component development, an image is developed while carrying a magnetic toner with a developer bearing member having a magnetic field generation unit such as a magnet thereinside. Therefore, this development is free from the problems associated with the nonmagnetic single component development. Nevertheless, this development suffers from a problem that scattering of toner tends to occur when it is applied to a high-speed machine.

SUMMARY OF THE INVENTION

The invention has been made in view of these circumstances, and provides an electrophotographic image forming method, an electrophotographic image forming apparatus and an electrophotographic image forming process unit.

According to an aspect of the invention, the electrophotographic image forming method includes a charging step of charging an electrostatic latent image bearing member, an exposure step of exposing the electrostatic latent image bearing member to exposure light to form an electrostatic latent image, a developing step of supplying a developer from a developer bearing member to the electrostatic latent image bearing member to develop the electrostatic latent image and form a toner image, and a transfer step of transferring the toner image on a transfer member. In this method, a process speed of the electrostatic latent image bearing member is 200 to 500 mm/sec, an outer diameter of the electrostatic latent image bearing member is 15 to 35 mm, an outer diameter of the developer bearing member is 10 to 25 mm, and a magnetic single component developer of which the residual magnetization in a measured magnetic field of 796 kA/m is 0.5 to 5.0 $Am^2/kg$ is used as the developer.

According to another aspect of the invention, the electrophotographic image forming apparatus includes a charging unit that charges an electrostatic latent image bearing member, an exposure unit that exposes the electrostatic latent image bearing member to exposure light to form an electrostatic latent image, a developing unit that supplies a developer from a developer bearing member to the electrostatic latent image bearing member to develop the electrostatic latent image and form a toner image, and a transfer unit that transfers the toner image on a transfer member. In the apparatus, an outer diameter of the electrostatic latent image bearing member is 15 to 35 mm, an outer diameter of the developer bearing member is 10 to 25 mm, a magnetic single component developer of which the residual magnetization in a measured magnetic field of 796 kA/m is 0.5 to 5.0 $Am^2/kg$ is used as the developer and a process speed of the electrostatic latent image bearing member is 200 to 500 mm/sec.

According to another aspect of the invention, the electrophotographic image forming process unit includes an electrostatic latent image bearing member, a toner chamber that stores a developer and a developing unit that supplies a developer from a developer bearing member to the electrostatic latent image bearing member to develop the electrostatic latent image and form a toner image, in which an outer diameter of the electrostatic latent image bearing member is 15 to 35 mm, an outer diameter of the developer bearing member is 10 to 25 mm, a magnetic single component developer of which the residual magnetization in a measured magnetic field of 796 kA/m is 0.5 to 5.0 $Am^2/kg$ is used as the developer and a process speed of the electrostatic latent image bearing member is 200 to 500 mm/sec.

According to the electrophotographic image forming method and the electrophotographic image forming apparatus of the invention, the process speed and the outer diameter of the electrostatic latent image bearing member and the outer diameter of the developer bearing member are controlled to the foregoing specific ranges, whereby the electrostatic latent image bearing member and the developer bearing member are downsized and the electrophotographic process is sped up without excessively increasing a centrifugal force acting on the toner on the latent image bearing member. Further, the magnetic single component developer to meet the specific condition of the residual magnetization is used to appropriately decrease the magnetic cohesive force of the toner on the electrostatic latent image bearing member, whereby a phenomenon of adhering an excessive amount of the toner to the electrostatic latent image bearing member is prevented satisfactorily. Accordingly, the downsizing and the weight reduction of the electrophotographic apparatus and the speed-up of the electrophotographic process can be attained at the same time, and good image quality can be obtained without scattering of toner.

BRIEF DESCRIPTION OF THE DRAWINGS

Preferred embodiments of the invention will be described in detail based on the following figures, wherein.

DETAILED DESCRIPTION OF PREFERRED EMBODIMENTS

Figure 1:
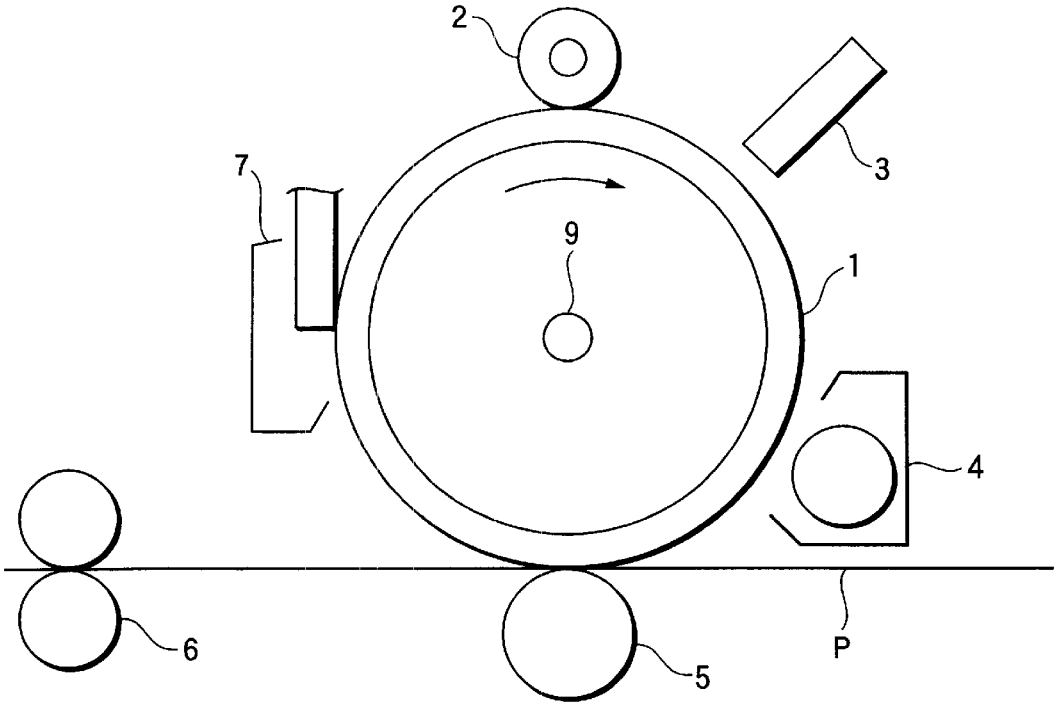
FIG. 1 is a schematic view showing an example of an electrophotographic apparatus used in an electrophotographic image forming method of the invention.

Preferred embodiments of the invention are described in detail below by sometimes referring to the drawings.

FIG. 1 is a schematic view showing an example of an electrophotographic apparatus preferably used in the electrophotographic image forming method of the invention. The apparatus shown in FIG. 1 includes an electrophotographic photoreceptor 1 as an electrostatic latent image bearing member, a charging member 2, an image input unit (exposure unit) 3, a developing unit 4, a transfer unit 5, an image fixing unit 6 and a cleaning unit 7. A magnetic single component developer of the invention is stored in the developing unit 4, and can be supplied from a developer bearing member of the developing unit 4 to the photoreceptor 1. Further, the photoreceptor 1 is supported by a support 9, and rotatably driven in the arrow direction at a process speed with the support 9 as a center. During the rotation of the photoreceptor 1, an electrostatic image forming step to be described later is conducted.

That is, the photoreceptor 1 rotated in the arrow direction with the support 9 as a center undergoes uniform charging with a positive or negative potential on the peripheral surface thereof by the charging member 2. Then, the photoreceptor 1 is subjected to image exposure by the image input unit (exposure unit) 3 to form an electrostatic latent image according to the exposed image on its peripheral surface. Subsequently, the magnetic single component developer of the invention is supplied from the developer bearing member of the developing unit 4 to the photoreceptor 1, and the developer (toner) is carried on the electrostatic latent image to form a toner image which is then transferred on a transfer member P with the transfer unit 5. After the toner image is transferred, the transfer member P is subjected to image fixing with the image fixing unit 6, and printed out as a copy. After the transfer step, the photoreceptor 1 is cleaned by removal of the toner remaining on its peripheral surface with the cleaning unit 7, and then repeatedly used in the image formation.

Figure 2:
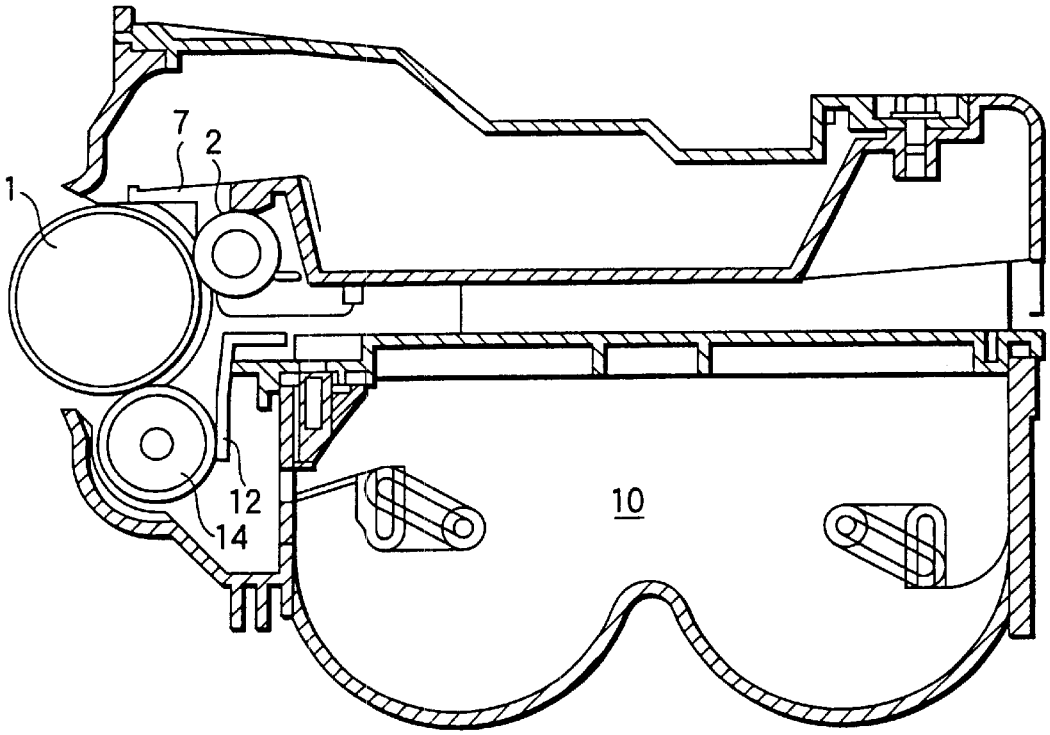
FIG. 2 is a schematic view showing an example of an electrophotographic image forming process unit of the invention.

FIG. 2 is a schematic view showing an example of the electrophotographic image forming process unit of the invention. The unit shown in FIG. 2 includes an electrophotographic photoreceptor 1 as an electrostatic latent image bearing member, a charging member 2, a developing roller 14, a cleaning unit 7 and a toner chamber 10. The magnetic single component developer of the invention is stored in the toner chamber 10, and can be supplied from the developing roller 14 to the photoreceptor 1. Further, the photoreceptor 1 is rotatably driven at a process speed.

The process speed of the electrostatic latent image bearing member (photoreceptor 1) in the invention is, 200 to 500 mm/sec, preferably 200 to 300 mm/sec. When the process speed of the electrostatic latent image bearing member exceeds the upper limit, a centrifugal force exerted on the toner on the electrostatic latent image bearing member is increased to provide an image quality deficiency such as scattering of toner. Meanwhile, when the process speed of the electrostatic latent image bearing member is less than the lower limit, the speed-up of the electrophotographic process is hardly attained.

The outer diameter of the electrostatic latent image bearing member of the invention is, 15 to 35 mm, preferably 20 to 35 mm. When the outer diameter of the electrostatic latent image bearing member is less than the lower limit, the curvature of the outer peripheral surface is increased to increase a centrifugal force exerted on the toner on the electrostatic latent image bearing member. As a result, an image quality deficiency such as scattering of toner is provided. Meanwhile, when the outer diameter of the electrostatic latent image bearing member exceeds the upper limit, the downsizing and the weight reduction of the electrophotographic apparatus are hardly attained.

The electrostatic latent image bearing member used in the invention is not particularly limited so long as the outer diameter is within the foregoing range and it can be rotated at the foregoing process speed. A known organic photoreceptor or inorganic photoreceptor can be used. In view of productivity, easy designing of materials and safety, an organic photoreceptor is preferable. Further, when the electrostatic latent image bearing member used in the invention is an organic photoreceptor, it may be a single-layer-type photoreceptor in which a charge generation material and a charge transport material are incorporated in the same layer, or a layered photoreceptor in which a photosensitive layer functionally separates into a charge generation layer containing a charge generation material and a charge transport layer containing a charge transport material. The use of the layered photoreceptor is preferable because high photosensitive property is obtained. Moreover, the electrostatic latent image bearing member may have, other than the photosensitive layer, an undercoat layer or a surface protecting layer as required.

The developer of the invention is a magnetic single component developer of which the residual magnetization in a measured magnetic field of 796 kA/m is 0.5 to 5.0 $Am^2/kg$, preferably 0.5 to 3.5 $Am^2/kg$. When the residual magnetization of the magnetic single component developer is less than the lower limit, transportability of the developer is decreased to make the image quality insufficient. Meanwhile, when the residual magnetization of the magnetic single component developer exceeds the upper limit, the magnetic cohesive force of the toner becomes excessively high, and an excessive amount of the toner therefore tends to be adhered to the electrostatic latent image bearing member to cause scattering.

The magnetic single component developer used in the invention is not particularly limited so long as the residual magnetization in the measured magnetic field of 796 kA/m meets the foregoing condition. A known magnetic single component developer containing a magnetic material and a binder resin is available.

Specific examples of the magnetic material used in the magnetic single component developer of the invention include metals such as iron, cobalt and nickel and alloys thereof; metal oxides such as $Fe_3O_4$, $\gamma$-$Fe_2O_3$ and cobalt-containing iron oxide; ferrites such as MnZn ferrite and NiZn ferrite; and magnetite, hematite, products obtained by surface-treating them with surface-treating agents such as a silane coupling agent and a titanate coupling agent and products obtained by coating them with a polymer. The residual magnetization of the magnetic single component developer containing this magnetic material can easily be controlled by properly selecting the type and the amount of the magnetic material. Among the magnetic materials listed above, spherical or polyhedral magnetite is preferable because the residual magnetization of the magnetic single component developer can be controlled to the foregoing range easily and surely.

The amount of the magnetic material in the magnetic single component developer of the invention is preferably 30 to 70% by weight, more preferably 35 to 55% by weight based on the total amount of the toner particles. When the amount of the magnetic material is less than the lower limit, there is a tendency that the attraction force of the toner with a magnet of the developer bearing member is decreased and a phenomenon such as scattering of toner or fogging occurs. Meanwhile, when the amount of the magnetic material exceeds the upper limit, an image density tends to be decreased.

An average particle size of the magnetic material in the magnetic single component developer of the invention is preferably 0.05 to 0.35 $\mu$m. When the average particle size of the magnetic material is within this range, dispersibility of the magnetic material in a binder resin to be described later tends to be improved.

Moreover, the BET specific surface area of the magnetic material in the magnetic single component developer of the invention is preferably 7 to 10 $m^2/g$. When the BET specific surface area of the magnetic material exceeds the upper limit, a moisture adsorption area of the magnetic material is excessively increased. Consequently, when it is used at a high temperature and high humidity, there is a tendency that chargeability is decreased owing to high moisture absorption of the developer. As a result, a phenomenon such as the decrease in image density or uneven density tends to occur. Meanwhile, when the BET specific surface area of the magnetic material is less than the lower limit, there is a possibility that the magnetic material takes a hexahedral or octahedral shape, dispersibility in a binder resin is decreased to provide nonuniform chargeability of the developer and a phenomenon such as uneven density or development ghost occurs. In addition, when the BET specific surface area of the magnetic material is less than the lower limit, the surface of the latent image bearing member tends to be damaged in electrostatic copying by dry development, and it is difficult to maintain a high level of image quality over a long period of time.

Specific examples of the binder resin used in the magnetic single component developer of the invention can include a homopolymer obtained by using one of polymerizable monomers, for example, styrenes such as styrene and chlorostyrene, monoolefins such as ethylene, propylene, butylene and isobutylene, vinyl esters such as vinyl acetate, vinyl propionate, vinyl benzoate and vinyl butyrate, $\alpha$-methylene aliphatic monocarboxylic acid esters such as methyl acrylate, ethyl acrylate, butyl acrylate, octyl acrylate, dodecyl acrylate, phenyl acrylate, methyl methacrylate, ethyl methacrylate, butyl methacrylate and dodecyl methacrylate, vinyl ethers such as vinylmethyl ether, vinylethyl ether and vinylbutyl ether and vinyl ketones such as vinyl methyl ketone, vinyl hexyl ketone and vinyl isopropenyl ketone; and a copolymer obtained from a combination of two or more of these polymerizable monomers. As a typical binder resin, polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, polyethylene and polypropylene are listed. Further, a polyester, a polyurethane, an epoxy resin, a silicone resin, a polyamide and a modified rosin are also available.

A release agent may be added to the magnetic single component developer of the invention for improving offset resistance. As the release agent used in the invention, paraffins having 8 or more carbon atoms and polyolefins are preferable. Specifically, paraffin wax, paraffin latex, microcrystalline wax and polypropylene are preferably used.

Various materials can be added to the magnetic single component developer of the invention for controlling charge. Specific examples thereof include fluorine-based surfactants, salicylic acid, iron-based dyes such as an iron complex, chromium-based dyes such as a chromium complex, polymer acids such as a copolymer containing maleic acid as a monomer component, quaternary ammonium salts, and azine-based dyes such as nigrosine. These can be used in amounts of 0.1 to 10% by weight. When a material having a charge control function is used as a binder resin, a satisfactory charge controlling property can be obtained without adding these materials.

In addition, for improving durability, fluidity and cleaning property of toner particles, inorganic fine particles such as silica and titanium oxide, organic fine particles such as fatty acids, derivatives thereof and metal salts thereof, and resin fine particles such as a fluororesin, an acrylic resin and a styrene resin can be added, as required, to the magnetic single component developer of the invention. When the inorganic fine particles are used, surfaces of the fine particles may be subjected to hydrophobic treatment. The average primary particle size of these fine particles is preferably 5 to 100 nm. Further, the amounts of the fine particles externally added are preferably 0.5 to 3% by weight per 100% by weight of the developer. When the amounts of the fine particles are less than 0.5% by weight, there is a tendency that the developer is hardly charged quickly and uniformly. Meanwhile, when the amounts of the fine particles exceed 3% by weight, the fine particles as the external additive are adhered to the electrostatic latent image bearing member, a phenomenon such as comet or filming tends to occur.

The magnetic single component developer of the invention can be produced by a known method. Production by a granulation method is especially preferable. In the production by the granulation method, a binder resin and a magnetic material are melt-kneaded with a heating kneader, cooled, then granulated and classified to obtain a desired magnetic single component developer.

In the thus-obtained magnetic single component developer of the invention, the volume average particle size is preferably 5 to 10 $\mu$m because the improvement of the image quality and the control of the increase in the amount of the developer consumed per sheet can be attained with a good balance. When the volume average particle size of the magnetic single component developer is less than the lower limit, there is a tendency that the image density is decreased or fogging occurs. Meanwhile, when it exceeds the upper limit, there is a tendency that granularity of the developer is decreased or an amount of the developer consumed per sheet is increased.

The magnetic single component developer of the invention having the foregoing construction is supplied from the developer bearing member of the developing unit to the electrostatic latent image bearing member in the electrophotographic image forming method of the invention. In the developing unit of the invention, the outer diameter of the developer bearing member is 10 to 25 mm, preferably 15 to 25 mm. When the outer diameter of the developer bearing member is less than the lower limit, there is a tendency that the contact area of the charging member having the developing unit and the developer is insufficient to decrease a charge amount of the toner, the toner having negative polarity and the toner having positive polarity are mixed to cause electrostatic cohesion and scattering of toner occurs to decrease the image quality.

The frequency of the developing bias AC component is preferably 1.5 to 4.0 kHz, more preferably 2.0 to 3.5 kHz. When the frequency exceeds 3.5 kHz, the toner cannot follow the AC electric field to decrease the image density. When the frequency is less than 2.0 kHz, toner having a small particle size flies to the non-image area to increase fogging. When the developing roller has a smaller diameter and the contact area with a layer forming blade is smaller, the charge amount of the toner becomes smaller, and this phenomenon notably occurs.

With respect to the electrophotographic image forming process unit of the invention, the volume ratio of the toner is preferably 60 to 99%, more preferably 65 to 98%. When the volume ratio of the toner is less than 65%, the toner in the toner chamber 10 is consumed before obtaining an appropriate number of printed sheets in case of using the same at high speed as in the invention. Thus, it is uneconomical. Meanwhile, when it exceeds 98%, there is no room for the volume of the toner chamber. Consequently, the toner tends to leak outside through vibration, and the pressure in filling the toner is increased. Therefore, the toner tends to be agglomerated within the toner chamber.

In the electrophotographic image forming method of the invention, the charging, exposure and transfer steps are not particularly limited so long as the process speed and the outer diameter of the electrostatic latent image bearing member, the outer diameter of the developer bearing member and the residual magnetization of the magnetic single component developer meet the foregoing conditions, and known steps can be used.

With respect to the charging unit of the invention, a contact-type charger having a contact charging member such as a conductive or semiconductive roller, a brush, a film or a rubber blade is mentioned. A voltage applied to the charging unit herein is preferably an AC voltage. When the contact charging method is a DC voltage method, there is a tendency that discharge is prevented satisfactorily between the photoreceptor and the charging member to prolong the life of the photoreceptor.

As the exposure unit of the invention, an optical device that can expose a desired image on the surface of the electrostatic latent image bearing member using a light source such as a semiconductor laser, LED (light emitting diode) or a liquid crystal shutter is mentioned.

In the transfer unit of the invention, a transfer member having a structure that an elastic layer containing a rubber, an elastomer or a resin and at least one coating layer are laminated on a conductive base member can be used. As a material used therein, a material obtained by dispersing conductive carbon particles or metallic powder in a resin such as a polyurethane resin, a polyester resin, a polystyrene resin, a polyolefin resin, a polybutadiene resin, a polyamide resin, a polyvinyl chloride resin, a polyethylene resin or a fluororesin is mentioned.

Further, in the invention, for removing the toner remaining on the surface of the electrostatic latent image bearing member after the transfer step, the cleaning step can be conducted as shown in FIG. 1. Examples of the cleaning unit used in the invention include a brush cleaner, a magnetic brush cleaner, an electrostatic brush cleaner, a magnetic roller cleaner and a blade cleaner.

Thus, the electrophotographic image forming method of the invention can provide good image quality without causing the scattering of toner in the downsizing and the weight reduction of the electrophotographic apparatus and the speed-up of the electrophotographic process. It is preferably used in the field of electrophotographic apparatus such as copying machines, printers and facsimiles, among others, electrophotographic apparatus for personal users requiring the downsizing, the weight reduction and the speed-up. Especially, the combination of the specific unit as the process unit can make the maintenance easy and provide a high-quality copy over a long period of time.

EXAMPLES

The invention is illustrated more specifically below with reference to Examples and Comparative Examples. However, the invention is not limited to these Examples at all.

(Measurement of a particle size, an average primary particle size, residual magnetization and a BET specific surface area)

The particle size is measured using a particle size measuring equipment (TA-II manufactured by Coulter Counter) with an aperture diameter of 100 $\mu$m.

With respect to the average primary particle size, an area average diameter calculated from a Martin's diameter of a project diameter using an image processing device (Image Analyzer LUZE XIII manufactured by NIRECO) on a 30,000×enlarged photo obtained with a scanning electron microscope is used.

The residual magnetization is measured using a vibration sample magnetometer (VSM-P10 manufactured by TOEI Industry Co., Ltd.).

The BET specific surface area is measured using betasorb automatic surface area meter (MODEL 4200 manufactured by Nikkiso Co., Ltd.).

Example 1

(Production of a magnetic single component developer)

A polyester resin [45.0 parts by weight, alcohol component: propylene oxide adduct of bisphenol A, acid component: terephthalic acid, glass transition temperature ($T_g$): 57° C., peak molecular weight: 5,600] as a binder resin, 50.0 parts by weight of magnetite (25-hedral material, average primary particle size: 0.21 $\mu$m, BET specific surface area: 7.6 $m^2/g$, residual magnetization in a measured magnetic field of 796 kA/m: 4.8 $Am^2/kg$) as a magnetic material, 1.0 part by weight of an Fe-containing azo dye (T77 made by Hodogaya Chemical Co., Ltd.) as a negatively chargeable charge control agent, 3.0 parts by weight of polypropylene wax (660P made by Sanyo Chemical Industries Ltd.) and 1.0 part by weight of polyethylene wax (PE 130 made by Hoechst AG) are dry-mixed with a Henschel mixer while being stirred, and heat-kneaded with an extruder (set-up temperature: 150° C.). The kneaded product is cooled, then coarsely crushed, and finely divided to obtain fine particles (volume average particle size: 5.7 μm) which are then classified to obtain a classified product (volume average particle size: 6.6 μm, particle size: a ratio of particles having a particle size of 4 μm or less is 20% by number).

To 100 parts by weight of the resulting classified product are externally added 1.0 part by weight of dimethyl silicone oil-treated silica (average primary particle size: 12 nm) and 1.0 part by weight of titanium oxide (average primary particle size: 50 nm) using a Henschel mixer to obtain a desired magnetic single component developer. The residual magnetization of the resulting magnetic single component developer in the measured magnetic field of 796 kA/m is 2.0 $Am^2/kg$.

(Printing test)

The magnetic single component developer is subjected to a test under the following conditions using an electrophotographic apparatus [Laser Press 4300 (remodeled for speed-up) manufactured by Fuji Xerox Co. Ltd.] shown in FIG. 1.

As the process unit, a unit shown in FIG. 2 is used, and installed in the electrophotographic apparatus. In this unit, the toner chamber (toner volume 2,100 cc) is filled with 1,350 g of the magnetic single component developer. At this time, the volume ratio of the toner is 95%.

Electrostatic latent image bearing member: cylindrical organic photoreceptor using a polycarbonate as a surface layer binder Process speed of the electrostatic latent image bearing member: 205 mm/sec Outer diameter of the electrostatic latent image bearing member: 30 mm Outer diameter of the developer bearing member: 18 mm Developing bias (AC): 1.8 kVp-p (frequency: 3.2 kHz)

Developing bias (DC): −350 V

Dark potential ($V_{high}$): −470 V

Bright potential ($V_{low}$): −100 V

Interval between the electrostatic latent image bearing member and the developer bearing member: 240 μm Test atmosphere: high temperature and high humidity (28° C., 85% RH) and low temperature and low humidity (10° C., 15% RH)

Under these conditions, a printing test of a character image for evaluation of an image quality is conducted. The resulting character image sample is observed with a magnifier, and a degree of scattering in the surrounding area of characters is evaluated. Consequently, a good image without scattering of the toner in the surrounding area of characters is obtained under both the test atmospheres of the high temperature and high humidity and the low temperature and low humidity.

Example 2

A magnetic single component developer is produced as in Example 1 except that a styrene-butyl acrylate copolymer (weight average molecular weight: approximately 140,000, glass transition temperature: 57° C.) is used as the binder resin of the magnetic single component developer. The residual magnetization of the resulting magnetic single component developer in the measured magnetic field of 796 kA/m is 2.1 $Am^2/kg$.

The printing test is conducted as in Example 1 except using this magnetic single component developer. Consequently, a good image without scattering of the toner in the surrounding area of characters is obtained under both the test atmospheres of the high temperature and high humidity and the low temperature and low humidity.

Example 3

A magnetic single component developer is produced as in Example 1 except that magnetite (spherical, average primary particle size: 0.20 μm, BET specific surface area: 7.7 $m^2/g$) having residual magnetization of 2.1 $Am^2$ in a measured magnetic field of 796 kA/m is used as a magnetic material of the magnetic single component developer. The residual magnetization of the resulting magnetic single component developer in the measured magnetic field of 796 kA/m is 1.0 $Am^2/kg$.

The printing test is conducted as in Example 1 except using this magnetic single component developer. Consequently, a good image without scattering of the toner in the surrounding area of characters is obtained under both the test atmospheres of the high temperature and high humidity and the low temperature and low humidity.

Example 4

A printing test is conducted as in Example 1 except using a developer bearing member having an outer diameter of 12 mm. Consequently, a good image without scattering of the toner in the surrounding area of characters is obtained under both the test atmospheres of the high temperature and high humidity and the low temperature and low humidity.

Example 5

A printing test is conducted as in Example 1 except using an electrostatic latent image bearing member having an outer diameter of 16 mm. Consequently, a good image without scattering of the toner in the surrounding area of characters is obtained under both the test atmospheres of the high temperature and high humidity and the low temperature and low humidity.

Comparative Example 1

A magnetic single component developer is produced as in Example 1 except that magnetite (octahedral material, average primary particle size: 0.22 μm, BET specific surface area: 6.8 $m^2/g$) having residual magnetization of 12.5 $Am^2$ in a measured magnetic field of 796 kA/m is used as the magnetic material of the magnetic single component developer. The residual magnetization of the resulting magnetic single component developer in the measured magnetic field of 796 kA/m is 5.9 $Am^2/kg$.

The printing test is conducted as in Example 1 except using this magnetic single component developer. Consequently, slight scattering of the toner is observed at the high temperature and high humidity, and notable scattering of the toner is observed at the low temperature and low humidity.

Comparative Example 2

A printing test is conducted as in Example 1 except using a developer bearing member having an outer diameter of 8 mm. Consequently, slight scattering of the toner is observed at the low temperature and low humidity, and notable scattering of the toner is observed at the high temperature and high humidity. Further, as the number of printed sheets is increased, an uneven image density notably occurs periodically by the rotation of the developer bearing member.

Comparative Example 3

A printing test is conducted as in Example 1 except using an electrostatic latent image bearing member having an outer diameter of 12 mm. Consequently, slight scattering of the toner is observed at the high temperature and high humidity, and notable scattering of the toner is observed at the low temperature and low humidity. Further, as the number of printed sheets is increased, an uneven image density notably occurs periodically by the rotation of the developer bearing member.

As has been thus far described, the electrophotographic image forming method of the invention can provide the good image quality without causing scattering of characters in the downsizing and the weight reduction of the electrophotographic apparatus and the speed-up of the electrophotographic process.

The entire disclosure of Japanese Patent Application No. 2000-270507 filed on Sep. 6, 2000 including specification, claims, drawings and abstract is incorporated herein by reference in its entirety.

What is claimed is:

1. An electrophotographic image forming method comprising:

charging an electrostatic latent image bearing member;

exposing the electrostatic latent image bearing member to exposure light to form an electrostatic latent image thereon;

supplying a developer from a developer bearing member to the electrostatic latent image bearing member and developing the electrostatic latent image to form a toner image; and transferring the toner image on a transfer member, wherein a process speed of the electrostatic latent image bearing member is 200 to 500 mm/sec, an outer diameter of the electrostatic latent image bearing member is 15 to 35 mm, an outer diameter of the developer bearing member is 10 to 25 mm, and a magnetic single component developer of which residual magnetization in a measured magnetic field of 796 kA/m is 0.5 to 5.0 $Am^2/kg$ is used as the developer.

2. The electrophotographic image forming method as claimed in claim 1, wherein the process speed of the electrostatic latent image bearing member is 200 to 300 mm/sec.

3. The electrophotographic image forming method as claimed in claim 1, wherein the step of developing the electrostatic latent image to form the toner image is conducted by applying a developing bias which has a frequency of 1.5 to 4.0 kHz as an AC component.

4. The electrophotographic image forming method as claimed in claim 1, wherein the residual magnetization of the magnetic single component developer in the measured magnetic field of 796 kA/m is 0.5 to 3.5 $Am^2/kg$.

5. The electrophotographic image forming method as claimed in claim 4, wherein an average particle size of a magnetic powder contained in the developer is 0.05 to 0.35 $\mu$m.

6. The electrophotographic image forming method as claimed in claim 5, wherein a BET specific surface area of the magnetic powder is 7 to 10 $m^2/g$.

7. The electrophotographic image forming method as claimed in claim 1, wherein the outer diameter of the electrostatic latent image bearing member is 20 to 35 mm.

8. The electrophotographic image forming method as claimed in claim 1, wherein the outer diameter of the developer bearing member is 15 to 25 mm.

9. An electrophotographic image forming apparatus, comprising:

a charging unit that charges an electrostatic latent image bearing member;

an exposure unit that exposes the electrostatic latent image bearing member to exposure light to form an electrostatic latent image;

a developing unit that supplies a developer from a developer bearing member to the electrostatic latent image bearing member to develop the electrostatic latent image and form a toner image; and a transfer unit that transfers the toner image on a transfer member, wherein an outer diameter of the electrostatic latent image bearing member is 15 to 35 mm, an outer diameter of the developer bearing member is 10 to 25 mm, a magnetic single component developer of which residual magnetization in a measured magnetic field of 796 kA/m is 0.5 to 5.0 $Am^2/kg$ is used as the developer and a process speed of the electrostatic latent image bearing member is 200 to 500 mm/sec.

10. The electrophotographic image forming apparatus as claimed in claim 9, wherein the outer diameter of the electrostatic latent image bearing member is 20 to 35 mm.

11. The electrophotographic image forming apparatus as claimed in claim 9, wherein the outer diameter of the developer bearing member is 15 to 25 mm.

12. The electrophotographic image forming apparatus as claimed in claim 9, wherein the process speed of the electrostatic latent image bearing member is 200 to 300 mm/sec.

13. The electrophotographic image forming apparatus as claimed in claim 9, wherein the development of the developing unit that develops the electrostatic latent image to form the toner image is conducted by applying a developing bias which has a frequency of 1.5 to 4.0 kHz as an AC component.

14. An electrophotographic image forming process unit, comprising:

an electrostatic latent image bearing member on which an electrostatic latent image is formed;

a toner chamber that stores a developer; and a developing unit that supplies the developer, which has been provided by the toner chamber, from a developer bearing member to the electrostatic latent image bearing member to develop the electrostatic latent image and form a toner image, wherein an outer diameter of the electrostatic latent image bearing member is 15 to 35 mm, an outer diameter of the developer bearing member is 10 to 25 mm, a magnetic single component developer of which residual magnetization in a measured magnetic field of 796 kA/m is 0.5 to 5.0 $Am^2/kg$ is used as the developer and a process speed of the electrostatic latent image bearing member is 200 to 500 mm/sec.

15. The electrophotographic image forming process unit as claimed in claim 14, wherein the residual magnetization of the magnetic single component developer in the magnetic field of 796 kA/m is 0.5 to 3.5 $Am^2/kg$.

16. The electrophotographic image forming process unit as claimed in claim 14, wherein the magnetic single component developer contains a magnetic powder, and an average particle size of the magnetic powder is 0.05 to 0.35 $\mu$m.

17. The electrophotographic image forming process unit as claimed in claim 16, wherein a BET specific surface area of the magnetic powder is 10 $m^2/g$.

18. The electrophotographic image forming process unit as claimed in claim 14, wherein an outer diameter of the electrophotographic latent image bearing member is 20 to 35 mm.

19. The electrophotographic image forming process unit as claimed in claim 14, wherein an outer diameter of the developer bearing member is 15 to 25 mm.

20. The electrophotographic image forming process unit as claimed in claim 14, wherein in the toner chamber that stores the developer, a toner volume ratio represented by the following formula is 60 to 99%:

Toner volume ratio=(volume of a toner filled)/(volume of a toner chamber)×100.

* * * * *